US008944250B2

(12) United States Patent
Huffer

(10) Patent No.: US 8,944,250 B2
(45) Date of Patent: Feb. 3, 2015

(54) MONO-WEB RESEALABLE PACKAGE WITH TAMPER-EVIDENT TEAR STRIP

(71) Applicant: Sonoco Development, Inc., Hartsville, SC (US)

(72) Inventor: Scott William Huffer, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 135 days.

(21) Appl. No.: 13/794,022

(22) Filed: Mar. 11, 2013

(65) Prior Publication Data

US 2014/0251849 A1 Sep. 11, 2014

(51) Int. Cl.

| | |
|---|---|
| ***B65D 73/00*** | (2006.01) |
| ***B65D 53/00*** | (2006.01) |
| ***B65D 85/30*** | (2006.01) |
| ***B65D 75/58*** | (2006.01) |
| ***B65D 33/18*** | (2006.01) |
| ***B65D 33/20*** | (2006.01) |

(52) U.S. Cl.

CPC ..... *B65D 53/00* (2013.01); *B65D 85/30* (2013.01); *B65D 75/5855* (2013.01); *B65D 33/18* (2013.01); *B65D 33/20* (2013.01); *Y10S 206/807* (2013.01); *Y10S 206/813* (2013.01)

USPC ..... 206/484.2; 206/807; 206/813; 383/204

(58) Field of Classification Search

USPC ..... 206/484, 484.2, 524.1, 524.2, 524.3, 206/524.6, 813, 807; 383/203, 204, 210, 383/211, 86

See application file for complete search history.

(56) References Cited

U.S. PATENT DOCUMENTS

| | | | |
|---|---|---|---|
| 3,338,019 | A | 8/1967 | Trewella et al. |
| 4,572,377 | A | 2/1986 | Beckett |
| 4,650,079 | A | 3/1987 | Tani |
| 4,923,309 | A | 5/1990 | Van Erden |
| 4,941,196 | A | 7/1990 | Edelman et al. |
| 4,961,503 | A | 10/1990 | Bell |
| 5,118,203 | A | 6/1992 | Andronico |
| 5,456,928 | A | 10/1995 | Hustad et al. |
| 5,882,749 | A | 3/1999 | Jones et al. |
| 5,945,146 | A | 8/1999 | Twinam |

(Continued)

FOREIGN PATENT DOCUMENTS

| | | |
|---|---|---|
| CA | 1 265 104 A1 | 1/1990 |
| DE | 79 12 210 UI | 10/1979 |

(Continued)

OTHER PUBLICATIONS

International Search Report and Written Opinion for Application No. PCT/US2014/021551 dated Jun. 16, 2014.

*Primary Examiner* — Jacob K Ackun
(74) *Attorney, Agent, or Firm* — Alston & Bird LLP

(57) ABSTRACT

A reclosable package formed from a sheet having a layered structure formed on a first region of the outer surface proximate a top edge thereof, formed by a pressure-sensitive adhesive (PSA) and a sealant coating covering the PSA. The sheet is folded about transverse fold lines and side seals are formed along the two side edges of the sheet, and a flap portion of the sheet overlaps the layered structure. Permanent seals are formed between the sealant coating of the layered structure and the flap portion. The first permanent seal has a higher bond strength than that between the sealant coating and the PSA.

15 Claims, 14 Drawing Sheets

(56) References Cited

U.S. PATENT DOCUMENTS

| | | | | |
|---|---|---|---|---|
| 6,610,338 | B2 | 8/2003 | Tang | |
| 6,743,451 | B2 | 6/2004 | Rasile et al. | |
| 7,341,160 | B2 | 3/2008 | Cappel et al. | |
| 7,404,488 | B2 * | 7/2008 | Verbruggen et al. | 206/484 |
| 7,491,433 | B2 * | 2/2009 | Bletsos et al. | 428/35.2 |
| 7,563,027 | B2 | 7/2009 | Allen et al. | |
| 7,744,517 | B2 | 6/2010 | Bonenfant | |
| 7,806,594 | B2 | 10/2010 | Trinko | |
| 8,167,487 | B2 | 5/2012 | Fuller | |
| 2007/0104395 | A1 * | 5/2007 | Kinigakis et al. | 383/61.1 |
| 2007/0205127 | A1 * | 9/2007 | Barndt et al. | 206/484 |
| 2009/0022431 | A1 | 1/2009 | Conner | |
| 2010/0276323 | A1 * | 11/2010 | Grossman | 206/440 |
| 2011/0235947 | A1 | 9/2011 | Austreng et al. | |
| 2013/0153445 | A1 * | 6/2013 | Cullison | 206/204 |

FOREIGN PATENT DOCUMENTS

| | | | |
|---|---|---|---|
| GB | 2 325 449 | A | 11/1998 |
| WO | WO 99/64308 | A1 | 12/1999 |
| WO | WO-03/066240 | A2 | 8/2003 |

* cited by examiner

MONO-WEB RESEALABLE PACKAGE WITH TAMPER-EVIDENT TEAR STRIP

BACKGROUND OF THE INVENTION

The present disclosure relates in general to packaging for products, and more particularly to packaging constructed from flexible film-based materials. The disclosure is especially concerned with such packages for perishable products, wherein the packages are reclosable after the initial opening.

Flexible film-based materials are commonly employed for constructing packages for products that are perishable, such as food products that must be protected against oxygen exposure and must be prevented from either drying out (in the case of moist products such as cheese, or wet wipes) or from picking up moisture from the outside environment (in the case of dry products such as crackers or cookies). If the product is of the type that will be used little by little over time, then it is desirable to provide a way to reclose the package after it is opened for the first time, so that the remaining product in the package is still protected against continual oxygen infiltration and moisture vapor transmission. Various configurations of film-based packages that are reclosable have been developed. Further improvements in such packages are desired.

BRIEF SUMMARY OF THE DISCLOSURE

The present disclosure describes a package for a product, formed from a sheet having an outer surface and an opposite, product-facing inner surface, the sheet having a top edge and an opposite bottom edge each extending in a transverse direction, and two opposing side edges each extending in a perpendicular longitudinal direction, between the top and bottom edges.

A layered structure is formed on a discrete first region of the outer surface proximate the top edge thereof extending substantially from one of the side edges to the other of the side edges, the layered structure comprising a pressure-sensitive adhesive (PSA) disposed on the first region of the sheet, and a non-tacky sealant coating disposed over and covering the PSA such that the PSA is not exposed as long as the sealant coating is in place.

The sheet is folded about fold lines that extend in the transverse direction, so as to envelop the product, with the inner surface of the sheet facing the product, side seals being formed along the two opposing side edges of the sheet, and a flap portion of the sheet adjacent the bottom edge thereof overlapping the layered structure and the sealant material.

The sheet includes sealant material disposed on the inner surface of the sheet at least along the two opposite side edges for forming the side seals, and along a first portion of the inner surface of the flap portion of the sheet.

A first permanent seal is formed between the sealant coating of the layered structure and the sealant material on the first portion of the inner surface of the flap portion of the sheet. The first permanent seal has a bond strength exceeding that existing between the sealant coating and the PSA, such that peeling back the flap portion causes the sealant coating to be lifted from the PSA and thereby exposes the PSA, which can then be used for resealing the flap portion to reclose the package.

The package in the above-noted embodiments having the optional second permanent seal can include a tear strip formed in the flap portion of the sheet at a location between the first and second permanent seals, the tear strip being severable from the flap portion so as to detach the flap portion from the second permanent seal and allow the flap portion to be peeled back.

In some embodiments, the sheet comprises an outer sealant web and a seal-inhibiting material covering the outer sealant web except for the second region, such that the sealant web is exposed at the second region for forming the second permanent seal with the flap portion. The seal-inhibiting material can comprise, for example, a heat-resistant over-lacquer.

The sheet can be a laminate that has one or more other layers. In one embodiment, the sheet further comprises a barrier web underlying the outer sealant web. The sheet can further comprise an inner sealant web underlying the barrier web.

In some embodiments, the sealant coating comprises an emulsion of sealant composition. The emulsion can comprise a polyethylene emulsion or the like.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

Figure 1:
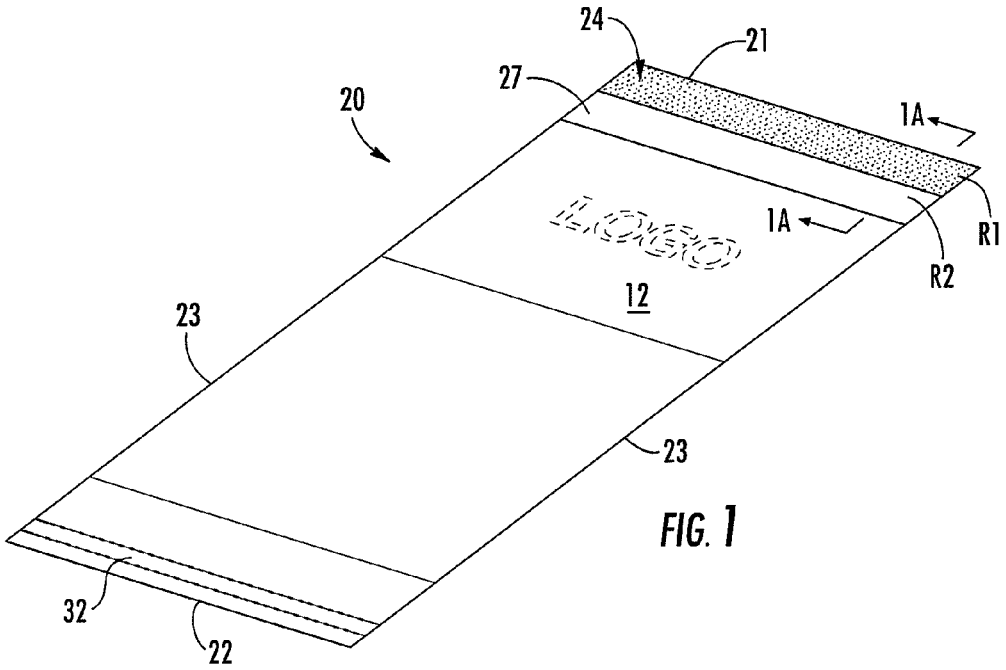
FIG. 1 is a perspective view of a blank or sheet of flexible film material from which a package in accordance with an embodiment of the present disclosure is constructed.

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIGS. 3C through 4C illustrate a package 10 in accordance with one embodiment of the present invention. FIGS. 1 through 3B illustrate the construction of the package. The package is formed from a sheet 20 having an outer surface 12 and an opposite, product-facing inner surface 14 (FIG. 3A). The sheet has a top edge 21 and an opposite bottom edge 22 each extending in a transverse direction, and two opposing side edges 23 each extending in a perpendicular longitudinal direction, between the top and bottom edges 21 and 22.

The sheet 20 includes a layered structure 24 formed on a discrete first region R1 of the outer surface 12 proximate the top edge 21 thereof and extending substantially from one of the side edges 23 to the other of the side edges 23. The layered structure comprises a pressure-sensitive adhesive (PSA) 25 disposed on the first region of the sheet, and a non-tacky sealant coating 26 disposed over and covering the PSA 25 such that the PSA is not exposed as long as the sealant coating 26 is in place.

The sealant coating 26 can be any suitable material that can be pattern-applied and that will form good heat seals. Examples of suitable materials for the sealant coating include polyethylene emulsion, acrylic, urethane, ethyl vinyl acetate, and the like.

A sealant material 27 is disposed on a second region R2 of the outer surface 12 of the sheet adjacent the layered structure 24. In the illustrated embodiment, the sealant material 27 comprises a portion of a sealant web 27 that is a top or outer layer of a multilayer laminate making up the sheet 20. The laminate more particularly includes the outer sealant web 27, a barrier web 28 underlying the outer sealant web, and a lower or inner sealant web 29 underlying the barrier web. The sheet further includes a seal-inhibiting layer 30 that covers the outer sealant web 27 except for in the first region R1 and second region R2 of the sheet, whereby the sealant web 27 is exposed in this second region, for purposes to be explained below. The seal-inhibiting layer 30 can comprise any material that is heat-resistant and inhibits formation of a strong heat seal. Examples of suitable materials for the seal-inhibiting layer 30 include lacquers, two-component primers such as urethane, and the like.

The outer sealant web 27 and inner sealant web 29 can each comprise any of various materials suitable for forming heat seals with high peel strength so that they are essentially permanent seals. Examples of suitable materials for the sealant webs include polypropylene, polyethylene (HDPE, LDPE, LLDPE), polyethylene terephthalate (PET), nylon, and the like.

The barrier web 28 is present for providing a barrier to the passage of oxygen and moisture vapor, so that the product inside the package is protected against infiltration of oxygen (which leads to more-rapid product spoilage) and so that moisture in the product (in the case of a moist product such a cheese) is prevented from escaping through the package material (which leads to more-rapid drying out of the product). Examples of suitable barrier materials include ethylene vinyl alcohol copolymer (EVOH), polyvinylidene chloride (PVDC), polyvinyl alcohol (PVOH), aluminum oxide coated PET (ALOx), nanocoated materials, metallized PET, metallized OPP and the like.

In cases where the material making up the outer sealant web 27 is also an adequate barrier, the separate barrier layer 28 can be omitted. Furthermore, in some cases, the sheet can consist of a single sealant layer, to which the layered structure 24 and heat-resistant coating 30 is applied. Thus, the invention is not limited to multi-layered laminates, and when laminates are employed, the invention is not limited to any particular number of layers.

The sheet 20 further includes a tear strip 32 formed by making two spaced generally parallel lines of weakness 33 in the sheet material, extending from one side edge 23 to the opposite side edge 23 of the sheet. The lines of weakness 33 can be formed in any suitable mariner, e.g., by mechanical cutting, scoring, or perforating, or using a laser.

Figure 1A:
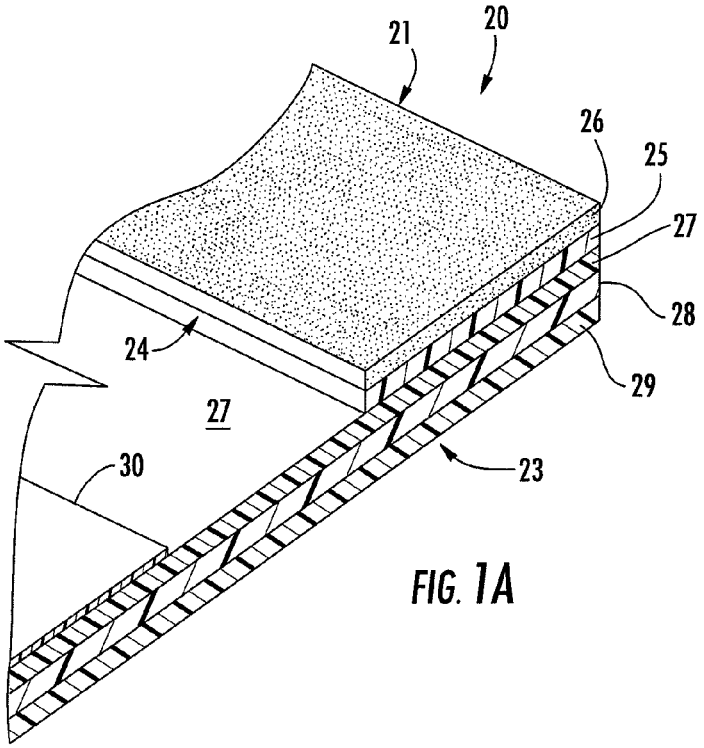
FIG. 1A is a sectioned perspective view of a portion of the sheet of FIG. 1, greatly magnified (with relative thicknesses not to scale, for illustrative purposes), showing the multi-layer structure of the sheet.
Figure 2:
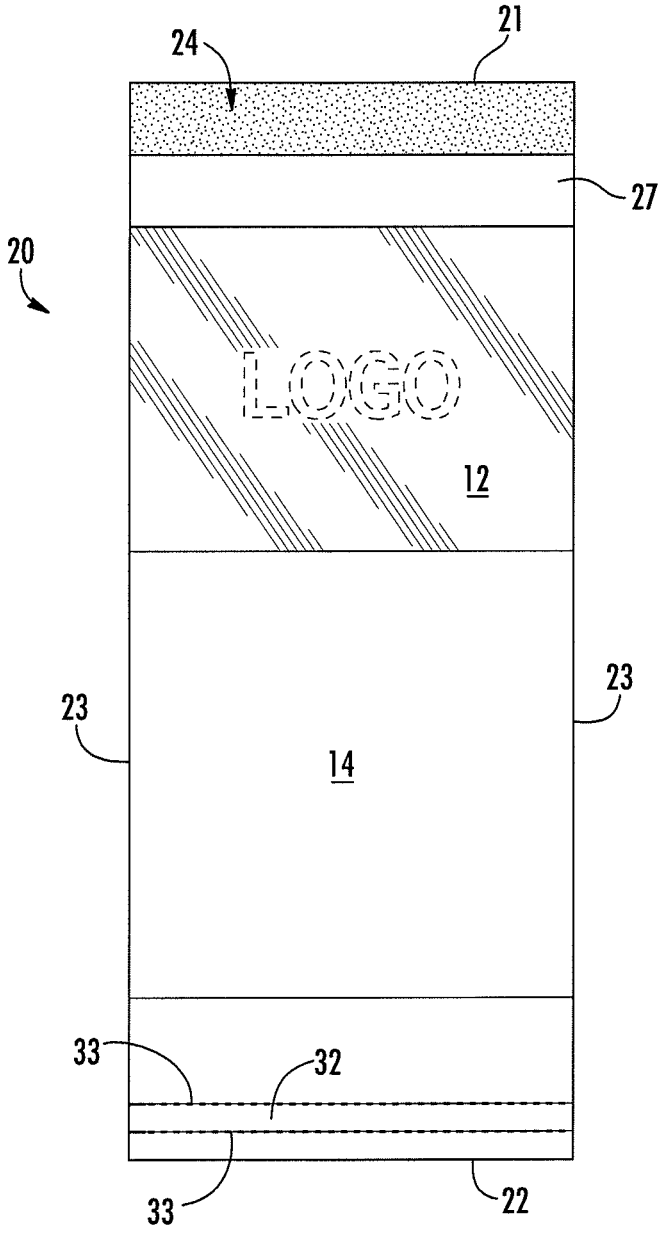
FIG. 2 is a top view of the sheet of FIG. 1.
Figure 3A:
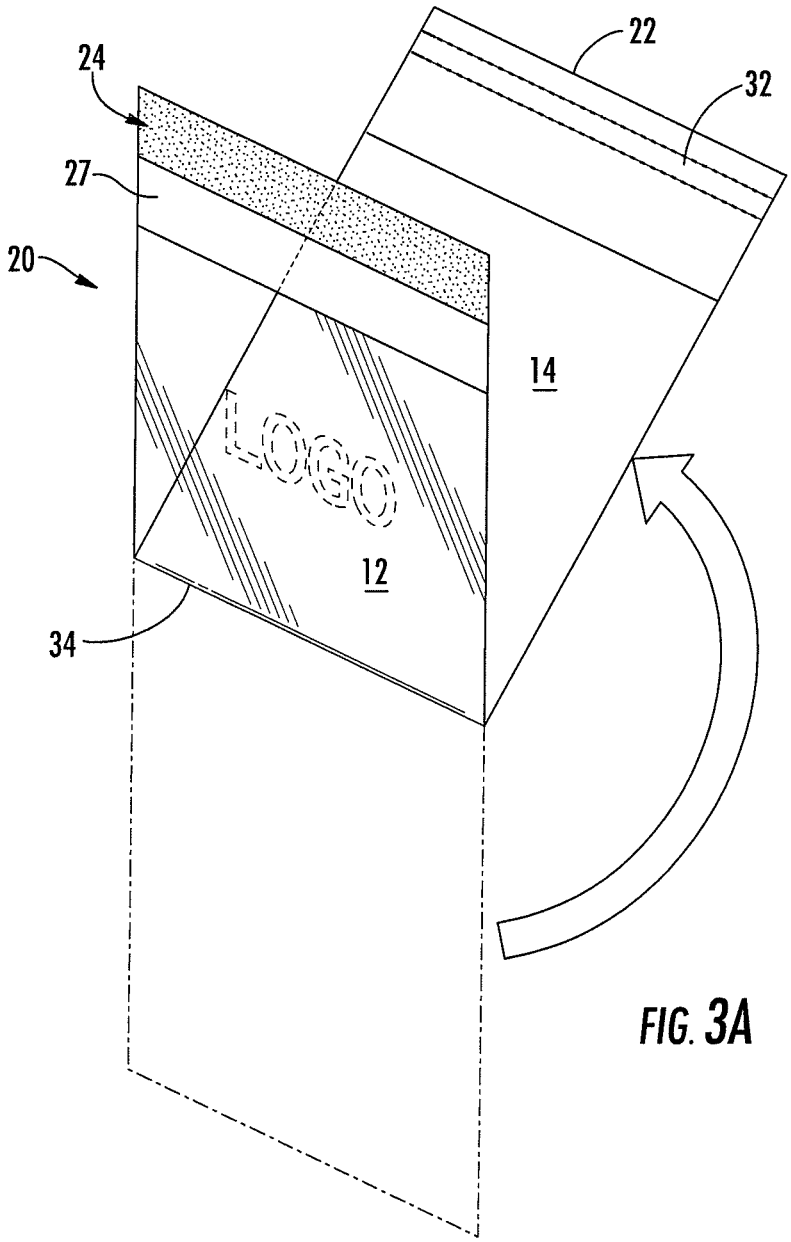
FIG. 3A shows a first of a series of steps for converting the sheet of FIG. 1 into a package.
Figure 3B:
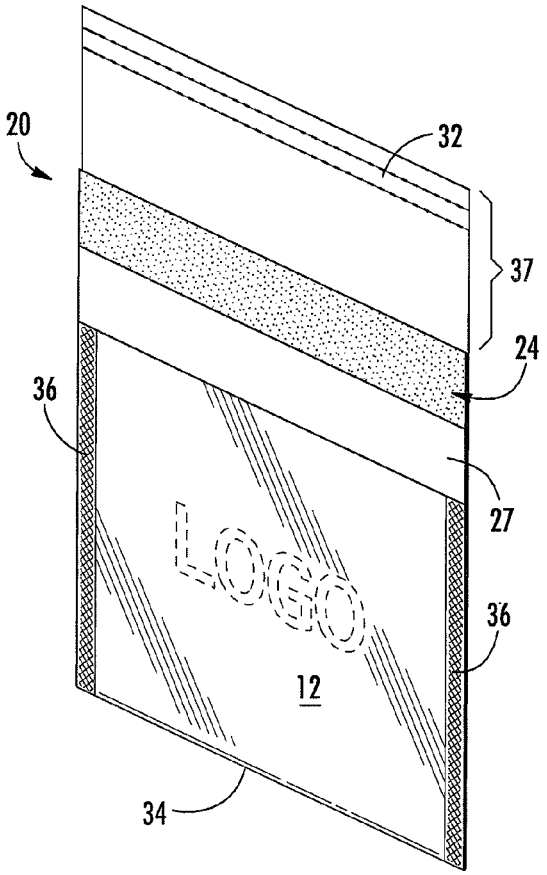
FIG. 3B shows the resulting configuration after the step of FIG. 3A.
Figure 3C:
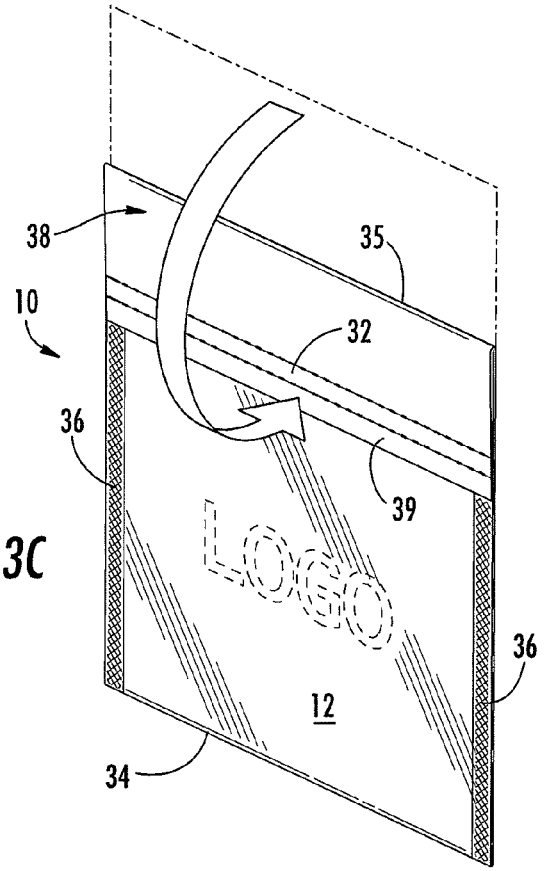
FIG. 3C shows a next step for converting the sheet into a package, and illustrates the resulting package.

To construct a package from the sheet 20, the sheet is folded about a fold line 34 (FIGS. 3A through 3C) that extends in the transverse direction. The fold line 34 is located so that the bottom portion of the sheet (i.e., the portion extending between the fold line 34 and the bottom edge 22) is longer than the top portion (i.e., the portion extending between the fold line 34 and the top edge 21), as shown for example in FIG. 3B. Side seals 36 (constituting permanent seals, such as heat seals) are then formed along the two opposing side edges 23 of the sheet, thereby forming an envelope-type configuration that is still open at the end opposite from the fold line 34. Once the product is inside the package, a flap portion 37 of the sheet adjacent the bottom edge 22 is then folded about a fold line 35 (FIG. 3C) so that the flap portion overlaps the layered structure 24 and the sealant material 27. A first permanent seal 38 is formed between the sealant coating 26 of the layered structure 24 (FIG. 1A) and a first portion of the inner surface of the flap portion 37. A second permanent seal 39 is formed between the region of sealant material 27 and a second portion of the inner surface of the flap portion 37. These two permanent seals 38 and 39 are located on opposite sides of the tear strip 32.

Figure 4A:
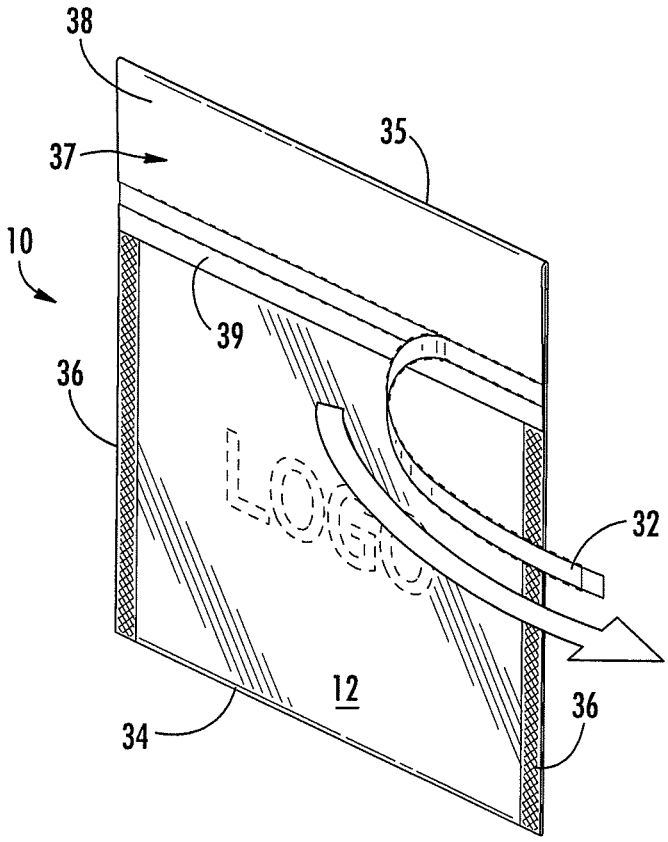
FIG. 4A illustrates a first step for opening the package.
Figure 4B:
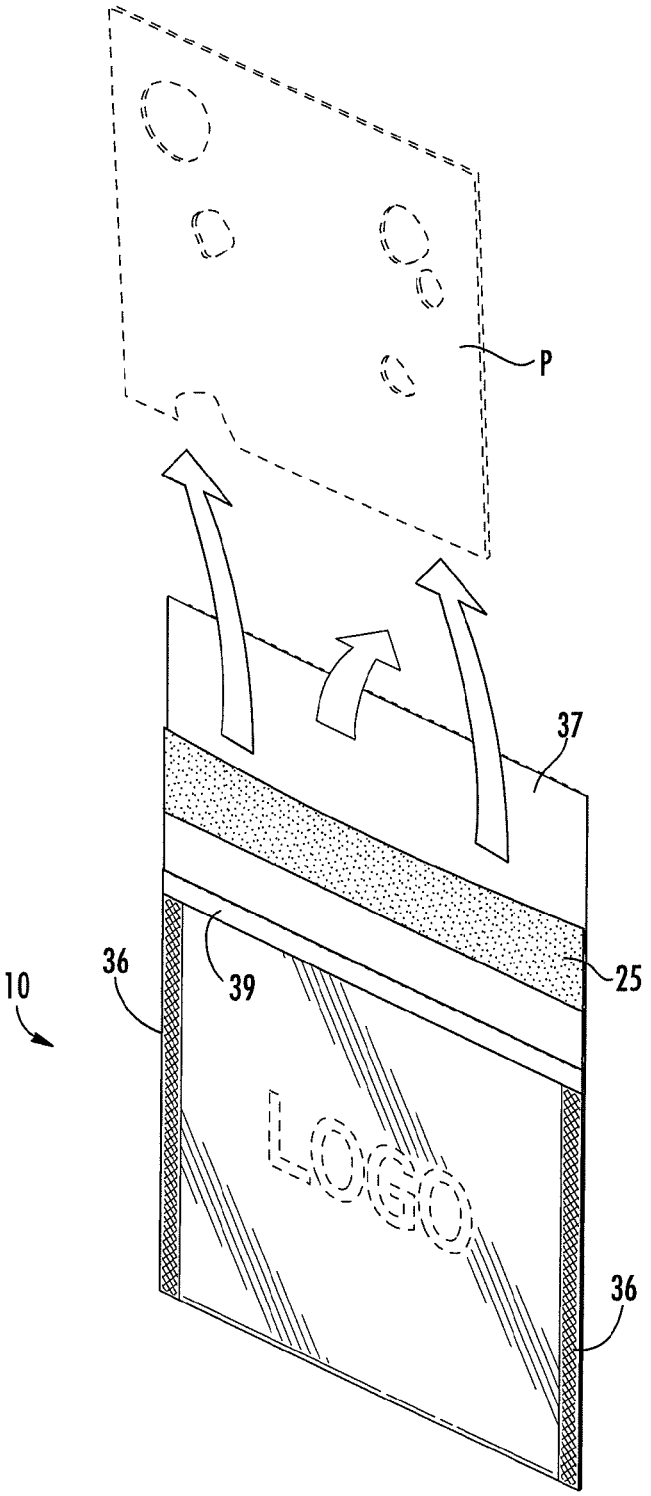
FIG. 4B shows a portion of the contained product being removed from the opened package.
Figure 4C:
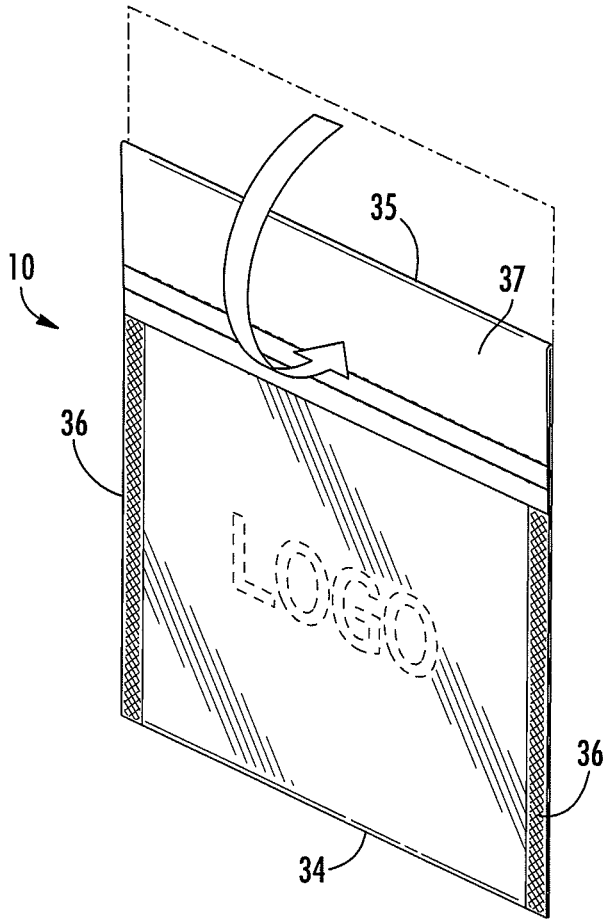
FIG. 4C illustrates the reclosing of the package.

The first permanent seal 38 has a bond strength exceeding that existing between the sealant coating 26 and the PSA 25 of the layered structure 24. Accordingly, severing the flap portion 37 at a location between the first and second permanent seals—for example, by tearing off the tear strip 32 (FIG. 4A)—and peeling back the flap portion 37 causes the sealant coating 26 to be lifted from the PSA 25 and remain attached to the flap portion. This exposes the PSA as shown in FIG. 4B. After product P is removed from the package, the PSA 25 can then be used for resealing the flap portion to reclose the package as depicted in FIG. 4C.

The necessity of removing the tear strip 32 before the flap 37 can be peeled back effectively provides a tamper-evidence feature. Once the tear strip is removed, that fact will be readily apparent from a casual visual inspection of the package.

The sheet 20 can be produced from a coextruded web of material that is subsequently surface-printed to apply the heat-resistant seal-inhibiting coating 30 and the PSA 25 and sealant coating 26 all on the same side of the web, and to form the lines of weakness 33, for each package length of the web. If the longitudinal dimension of the web extends in the transverse direction of the sheets to be produced from the web, then the PSA coating, sealant coating, heat-resistant coating, and lines of weakness can be formed continuously along the longitudinal direction of the web, and it is then necessary merely to sever the web into package-widths to produce the sheets 20.

It will be understood that in the above-described embodiment, the side seals 36 are formed by virtue of the sheet 20 itself comprising a sealant material at least on its inner surface. As such, the sealant coating 26 must have a heat-sealing temperature sufficiently lower than the melting point of the sealant material of the basic sheet 20 itself so that when the heat seal is formed between the flap portion 37 and the layered structure 24, the inner surface of the two opposing portions of the sheet 20 do not also seal together at the package mouth, which would render the package unopenable in the intended manner. Thus, in this embodiment, it is important to select carefully the material of the sealant coating 26 and the materials making up the sheet 20 with this consideration in mind.

Figure 5:
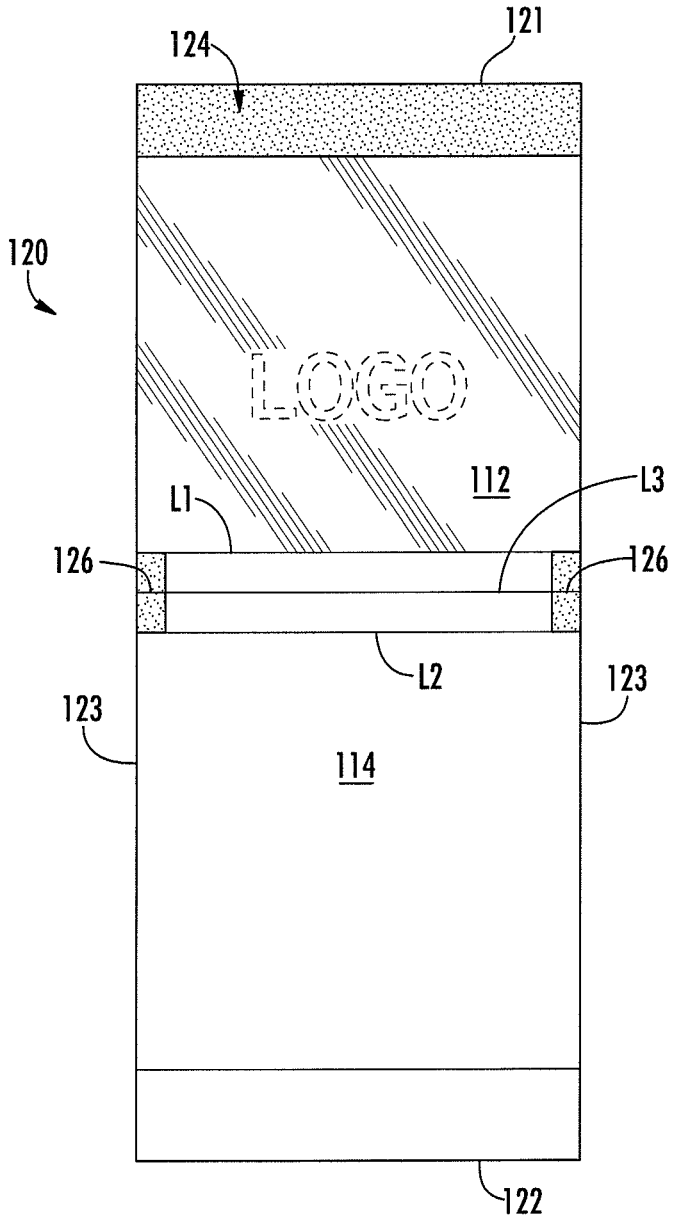
FIG. 5 is a top view of the sheet in accordance with a further embodiment of the present disclosure.
Figure 6:
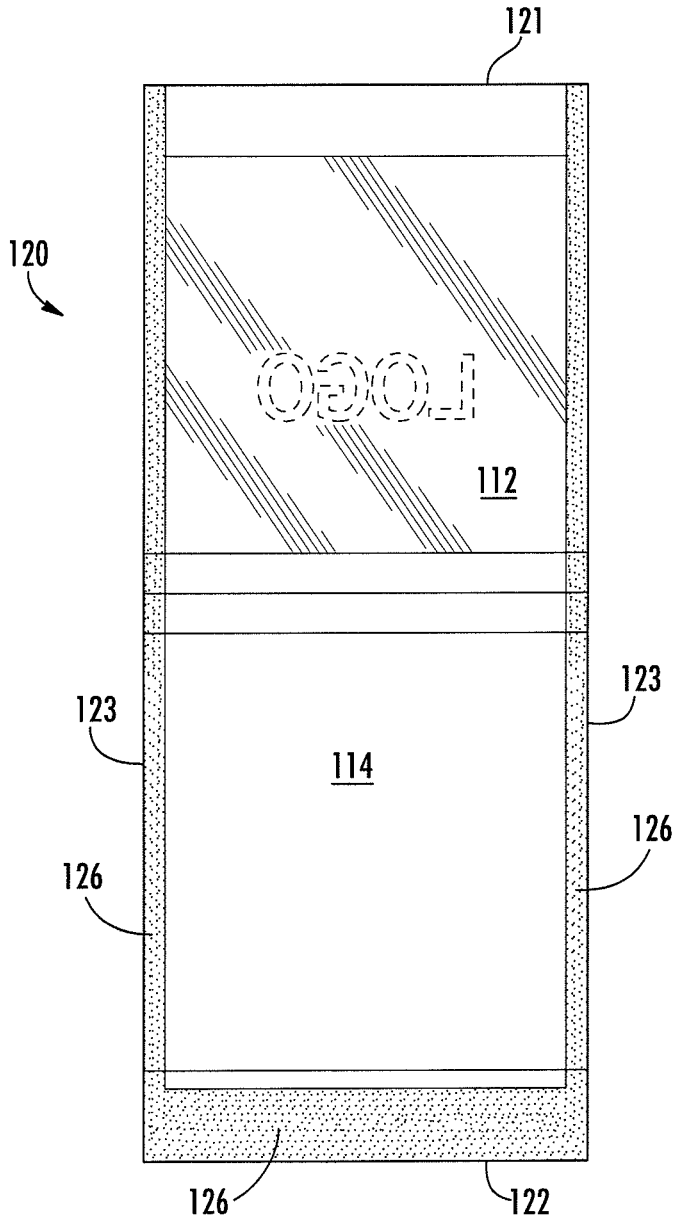
FIG. 6 is a bottom view of the sheet (i.e., a plan view of the reverse side relative to FIG. 5)

A second embodiment that does not require the sheet to have any sealant material, and that therefore does not require the above-noted material-selection considerations, is illustrated in FIGS. 5 through 7. FIG. 5 shows a top view of the sheet 120, which is similar to the previously described sheet in some respects; thus, the present description focuses primarily upon the significant differences relative to the previous embodiment. The sheet has a top or outer surface 112 and an opposite bottom or inner (product-facing) surface 114, and has a top edge 121, a bottom edge 122, and side edges 123. In this current embodiment, the material makeup and construction of the basic starting sheet material (i.e., before application of the PSA and sealant coating materials) is not particularly important, as noted, because all seals required for making the package are formed by the applied sealant coating.

The current embodiment includes a layered structure 124 which is essentially the same as the previously described layered structure 24. Thus the layered structure includes an outermost layer of the sealant coating. Additionally, the sealant coating is also applied to other regions of the sheet. Specifically, sealant coating 126 is applied to two discrete areas of the sheet adjacent the opposite side edges and bounded between two fold lines L1 and L2 that are used along with a third fold line L3, as later described, for forming a bottom gusset in the package. Furthermore, on the reverse side of the sheet, as shown in FIG. 6, sealant coating 126 is applied to a discrete area adjacent the bottom edge 122 and to discrete longitudinally extending areas adjacent the two side edges 123.

Figure 7A:
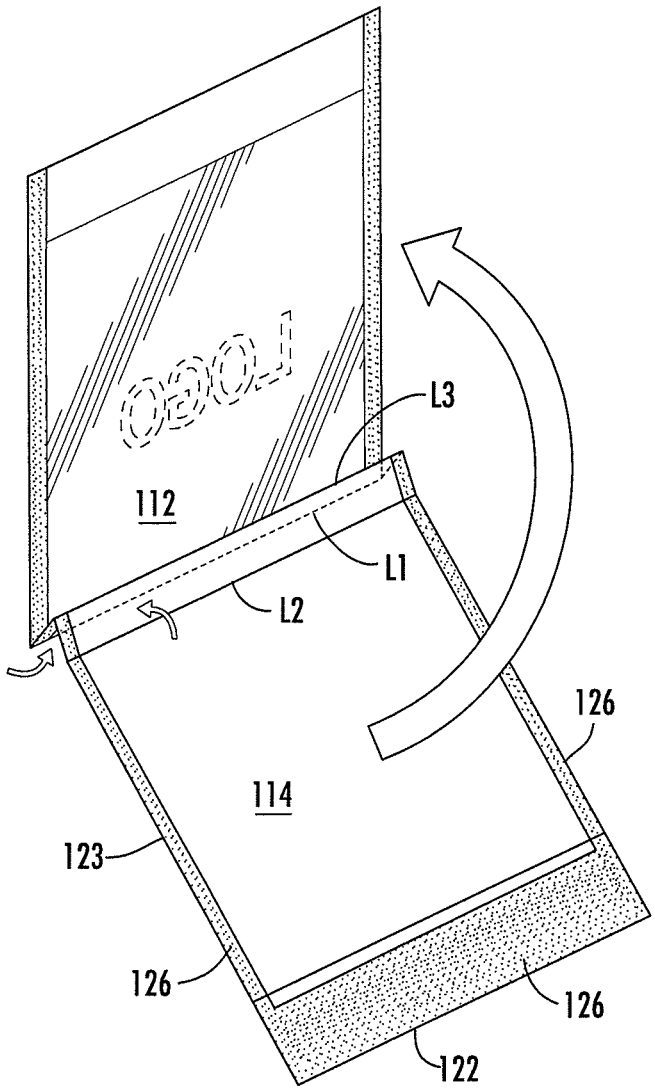
FIG. 7A illustrates a first step in forming the sheet into a package.

The conversion of the sheet 120 into a package is generally similar to that of the previous embodiment, although, as noted, the current package has a bottom gusset. As shown in FIG. 7A, the bottom gusset is formed by folding the sheet in one direction about the fold lines L1 and L2 and in the opposite direction along the fold line L3 (i.e., so that the fold line L3 projects inwardly toward the package contents). The sealant coating 126 on the outer side of the package in the gusset region will be used during formation of the side seals (described below) so that the two "leaves" of the gusset are sealed together locally in the regions adjacent the side edges.

Figure 7B:
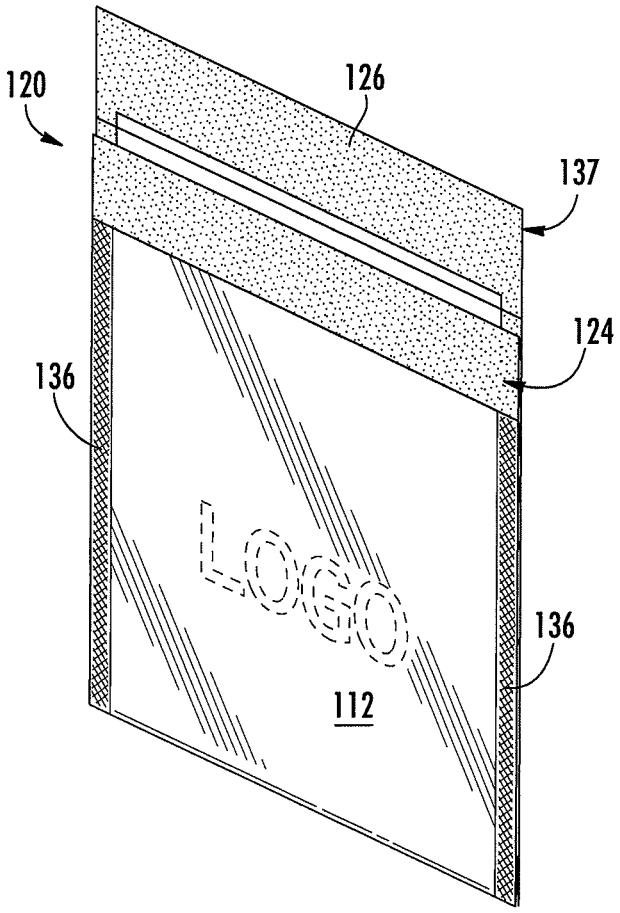
FIG. 7B illustrates a next step in forming the sheet into a package.
Figure 7C:
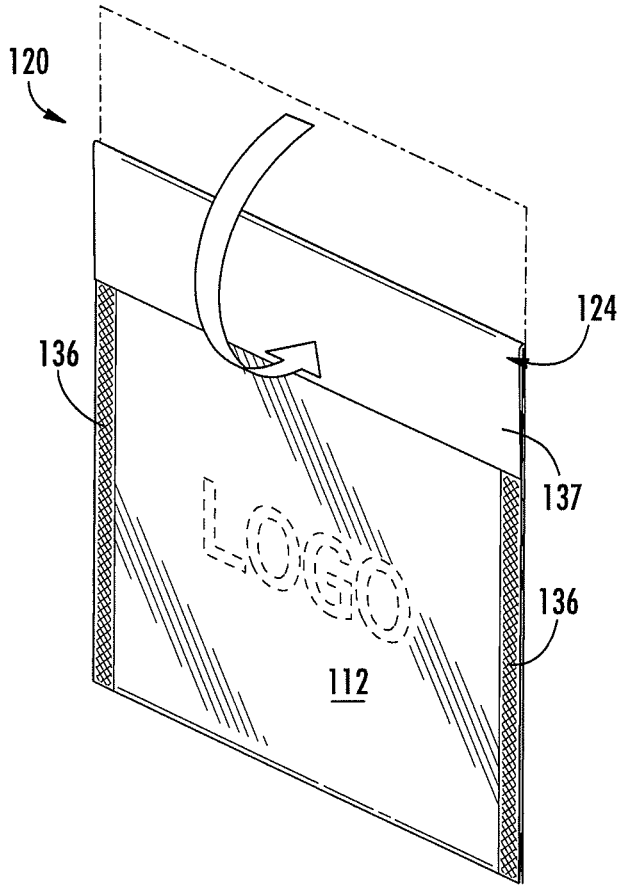
FIG. 7C shows a further step for converting the sheet into a package, and illustrates the resulting package.

As shown in FIG. 7B, side seals 136 are formed by using the sealant coating 126 on the inner side of the sheet. Then, after product is inside the package, the flap portion 137 is folded down and sealed to the layered structure 124 as shown in FIG. 7C.

Figure 7D:
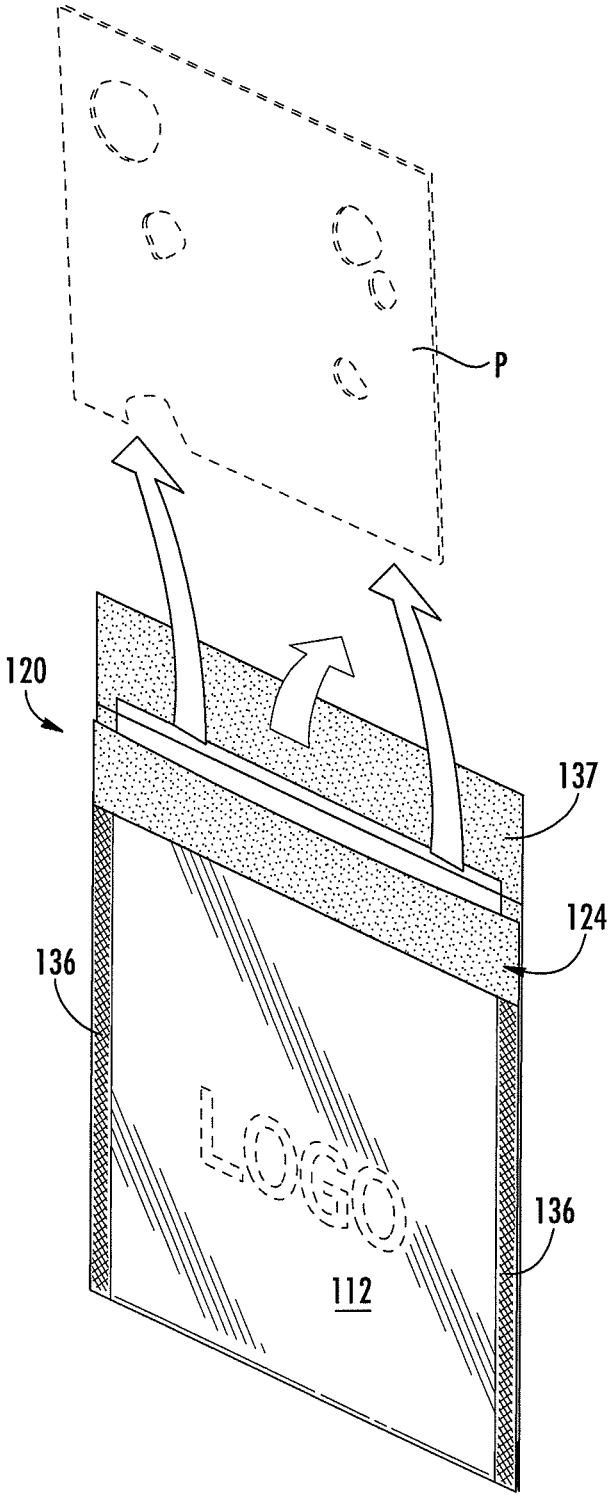
FIG. 7D illustrates opening the package and a portion of the contained product being removed from the opened package.
Figure 7E:
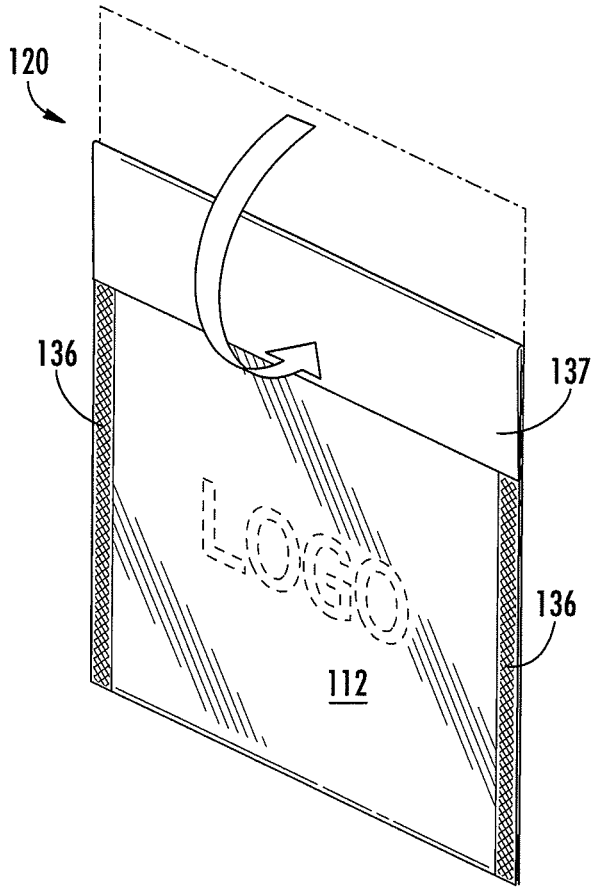
FIG. 7E illustrates the reclosing of the package.

FIGS. 7D and 7E illustrate the initial opening and removal of product from the package, and the reclosing of the package, respectively.

In this current embodiment, as noted, the basic sheet material need not have sealant properties, since all of the permanent/non-resealable seals are made by the added sealant coatings 126.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A package for a product, comprising:

a sheet having an outer surface and an opposite, product-facing inner surface, the sheet having a top edge and an opposite bottom edge each extending in a transverse direction, and two opposing side edges each extending in a perpendicular longitudinal direction, between the top and bottom edges;

a layered structure formed on a discrete first region of the outer surface proximate the top edge thereof and extending substantially from one of the side edges to the other of the side edges, the layered structure comprising a pressure-sensitive adhesive (PSA) disposed on the first region of the sheet, and a non-tacky sealant coating disposed over and covering the PSA such that the PSA is not exposed as long as the sealant coating is in place;

the sheet being folded about fold lines that extend in the transverse direction, so as to envelop the product, with the inner surface of the sheet facing the product, side seals being formed along the two opposing side edges of the sheet, and a flap portion of the sheet adjacent the bottom edge thereof overlapping the layered structure and the sealant material;

sealant material disposed on the inner surface of the sheet at least along the two opposite side edges for forming the side seals, and along a first portion of the inner surface of the flap portion of the sheet;

a first permanent seal between the sealant coating of the layered structure and the sealant material on the first portion of the inner surface of the flap portion of the sheet;

wherein the first permanent seal has a bond strength exceeding that existing between the sealant coating and the PSA, such that peeling back the flap portion causes the sealant coating to be lifted from the PSA and thereby exposes the PSA, which can then be used for resealing the flap portion to reclose the package.

2. The package of claim 1, further comprising a sealant material disposed on a second region of the outer surface of the sheet adjacent the layered structure, and a second permanent seal between the sealant material on the second region and a second portion of the inner surface of the flap portion, whereby peeling back the flap portion requires first severing the flap portion at a location between the first and second permanent seals.

3. The package of claim 2, further comprising a tear strip formed in the flap portion of the sheet at a location between the first and second permanent seals, the tear strip being severable from the flap portion so as to detach the flap portion from the second permanent seal and allow the flap portion to be peeled back.

4. The package of claim 2, wherein the sheet comprises an outer sealant web and a seal-inhibiting material covering the outer sealant web except for the second region, such that the sealant web is exposed at the second region for forming the second permanent seal with the flap portion.

5. The package of claim 4, wherein the sheet further comprises a barrier web underlying the outer sealant web.

6. The package of claim 5, wherein the sheet further comprises an inner sealant web underlying the barrier web.

7. The package of claim 1, wherein the sealant coating comprises an emulsion of sealant composition.

8. The package of claim 7, wherein the emulsion comprises a polyethylene emulsion.

9. The package of claim 7, wherein the emulsion comprises an acrylic emulsion.

10. The package of claim 7, wherein the emulsion comprises a urethane emulsion.

11. The package of claim 7, wherein the emulsion comprises an ethylene vinyl acetate emulsion.

12. The package of claim 1, further comprising a reverse-side sealant coating disposed on the inner surface of the sheet, the reverse-side sealant coating being confined to discrete areas along the two opposite side edges and on the first portion of the flap portion, wherein the side seals and the first permanent seal are formed by the reverse-side sealant coating.

13. The package of claim 12, wherein the reverse-side sealant coating is disposed in a U-shaped configuration on the inner surface of the sheet, a base of the U-shaped configuration for forming the first permanent seal and legs of the U-shaped configuration for forming the side seals.

14. The package of claim 1, wherein a bottom of the package has a gusset.

15. The package of claim 14, further comprising the sealant coating disposed on discrete regions of the outer surface of the sheet proximate the side edges, localized to where the gusset is located, for sealing the sheet in the gusset.

* * * * *